US006764727B1

(12) United States Patent
Sismondi et al.

(10) Patent No.: US 6,764,727 B1
(45) Date of Patent: Jul. 20, 2004

(54) INK-JET PRINT RECEIVING SHEET COMPRISING A HIGH-BOILING ORGANIC SOLVENT AND AN AIONIC SURFACTANT

(75) Inventors: Alain Dominique Sismondi, Nice (FR); Giuseppe Loviglio, Savona (IT); Domenico Marinelli, Savona (IT); Andrea Novelli, Savona (IT)

(73) Assignee: Ferrania S.p.A., Ferrania (IT)

( * ) Notice: Subject to any disclaimer, the term of this patent is extended or adjusted under 35 U.S.C. 154(b) by 435 days.

(21) Appl. No.: 09/642,721

(22) Filed: Aug. 21, 2000

(30) Foreign Application Priority Data

Sep. 3, 1999 (IT) ..... SV99A0028

(51) Int. Cl.[7] ..... B41M 5/00

(52) U.S. Cl. ..... 428/32.24; 428/32.27

(58) Field of Search ..... 428/195, 478.2, 428/32.24, 32.27

(56) References Cited

U.S. PATENT DOCUMENTS

| | | | | | |
|---|---|---|---|---|---|
| 4,926,190 | A | * | 5/1990 | Laver | 346/1.1 |
| 5,688,603 | A | | 11/1997 | Iqbal et al. | |
| 5,707,722 | A | | 1/1998 | Iqbal et al. | 428/304.4 |
| 5,759,639 | A | | 6/1998 | Kloos | 427/542 |
| 5,866,268 | A | | 2/1999 | Sargeant et al. | 428/532 |
| 5,919,559 | A | | 7/1999 | Nakano et al. | 428/331 |

FOREIGN PATENT DOCUMENTS

| | | | |
|---|---|---|---|
| EP | 0 355 752 | 2/1990 | B41M/1/30 |

* cited by examiner

*Primary Examiner*—B. Hamilton Hess
*Assistant Examiner*—Bruce Hess
(74) *Attorney, Agent, or Firm*—Mark A. Litman & Associates, P.A.

(57) ABSTRACT

The ink jet receiving sheet of the invention comprises a support and at least one ink receiving layer, characterized in that said ink receiving layer comprises a high boiling organic solvent and a non-ionic surfactant dispersed in a hydrophilic binder as additives to improve black density of the resulting image.

18 Claims, No Drawings

INK-JET PRINT RECEIVING SHEET COMPRISING A HIGH-BOILING ORGANIC SOLVENT AND AN AIONIC SURFACTANT

FIELD OF THE INVENTION

The invention relates to an ink receptor for ink jet printers, and more particularly, to ink receptor containing a combination of a high boiling organic solvent and a non-ionic surfactant as additives to improve black density of the resulting image.

BACKGROUND OF THE INVENTION

Ink jet printing has become increasingly popular, particularly for so-called "desk-top publishing", because of its capability to produce small volumes of printed matter from digital input at high throughput speeds. Recent equipment developments have led to the introduction of multi-color ink jet printers that integrate colored graphics and text. To some extent, however, the applications of ink jet printing have been limited due to the demanding requirements the ink receptors must meet in order to provide high quality text and graphics.

One of the factors influencing the image quality of an ink jet image is the capacity to correctly reproduce black areas of the image. The ink-jet printers currently available on the market adopt two different techniques for obtaining black color. A first technique uses an ink based on a black pigment, such as, for example, carbon black, dispersed in a proper solvent. The second one uses the combination of the three primary colors (cyan, magenta and yellow).

The black density of the resulting image on the ink-jet receptor is strongly dependent upon the above technique and the kind of receptor. Up to now, good results have been obtained with the optimization of a receptor to a specific technique.

U.S. Pat. No. 5,866,268 discloses an ink jet receptor comprising an ink receiving layer based on a cellulose derivative which is able to give a good black density on images obtained with a Hewlett Packard DeskJet 660C (using the black pigment technique).

U.S. Pat. No. 5,707,722 discloses an ink jet receptor comprising an ink receiving layer comprising a combination of a cellulose derivative and a fluorinated non-ionic surfactant which is able to give a good black density on images obtained with a Hewlett Packard DeskJet 850 (using the black pigment technique).

U.S. Pat. No. 5,688,603 discloses an ink jet receptor comprising an ink receiving layer comprising a combination of a cellulose derivative, a fluorinated non-ionic surfactant and an alkanolamine metal chelate which is able to give a good black density on images obtained with an Epson Color Stylus (using the color combination technique).

However, it has been experienced that an ink jet receptor optimized for the black pigment technique does not give similar results with the color combination technique and viceversa. Thus, there is a need for improved ink receptors that show good black density when using both the above mentioned techniques.

SUMMARY OF THE INVENTION

The ink jet receiving sheet of the invention comprises a support and at least one ink receiving layer, characterized in that said ink receiving layer comprises a high boiling organic solvent and a non-ionic surfactant dispersed in a hydrophilic binder as additives to improve black density of the resulting image.

DETAILED DESCRIPTION OF THE INVENTION

The ink jet receiving sheet of the invention comprises at least one ink receiving layer coated on one or both surfaces of a support. The ink receiving layer(s) comprise a high boiling organic solvent and a non-ionic surfactant dispersed in a hydrophilic binder.

The high boiling organic solvents are hydrophobic organic compounds which have a melting point lower than 50° C. and a boiling point higher than 140° C. According to a preferred embodiment, the high boiling organic solvents are liquid at room temperature and have a boiling point higher than 170° C.

Examples of the high-boiling organic solvent are described in U.S. Pat. No. 2,322,027. Specific examples of high-boiling organic solvents include alkyl phthalates (e.g., dibutyl phthalate, diethyl phthalate, dimethoxyethyl phthalate, dioctyl phthalate, dicyclohexyl phthalate, di-2-ethylhexyl phthalate, decyl phthalate, bis-(2,4-di-t-amylphenyl) phthalate, bis-(2,4-di-t-amylphenyl) isophthalate and bis-(1,1-diethylpropyl) phthalate); alkyl carbonates (e.g., dioctyl carbonate, dodecyl carbonate, diphenyl carbonate); phosphoric ester (e.g., diphenyl phosphate, dioctyl butyl phosphate, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphate); citric esters (e.g., tributyl acetylcitrate); benzoic esters (e.g., octyl benzoate, 2-ethylhexyl benzoate, dodecyl benzoate and 2-ethylhexyl p-hydroxybenzoate); polyhydric alcohols (e.g., ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane and trimethylolpropane), alkyl ethers of polyhydric alcohols (e.g., ethylene glycol monomethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether and triethylene glycol monobutyl ether; urea, 2-pyrrolidone, N-methyl-2-pyrrolidone, 1,3-dimethyl-2-imidazolidinone and triethanolamine), alkylamides (e.g., N,N-diethyldodecaneamide, N,N-diethyllaurylamide and N-tetradecylpyrrolidone), fatty acid esters (e.g., dibutoxyethyl succinate, diethyl azelate, bis-(2-ethylhexyl) sebacate, dioctyl azelate, glycerol tributanoate, isostearyl lactate and trioctyl citrate), aniline derivatives (e.g., N,N-dibutyl-2-butoxy-5-tert-octylaniline), hydrocarbons (e.g., paraffin, dodecylbenzene, and diisopropylnaphthalene), and trimesic acid esters (e.g., tributyl trimesate). Preferred categories of high-boiling organic solvents are alkyl carbonates, phosphoric esters, alkyl phthalates, dibutyl phthalate and alkylamides. Most preferred high-boiling organic solvents are dioctyl carbonate, tricresyl phosphate, bis-(2-ethylhexyl) phtalate, dibutyl phtalate, diethyl lauramide.

The high boiling organic solvents are present in an amount of from 1 to 10 g/m$^2$, preferably from 2 to 8 g/m$^2$. When preparing the ink jet receiving sheet by coating a plurality of ink receiving layers, the above mentioned amount of high boiling organic solvents is added to the ink receiving layer nearest to the support.

Useful examples of non-ionic surfactants include non-ionic hydrocarbon surfactants and non-ionic fluorinated surfactants.

Useful examples of non-ionic hydrocarbon surfactants include ethers, such as polyoxyethylene nonyl phenyl ether, polyoxyethylene octyl phenyl ether, polyoxyethylene dodecyl phenyl ether, polyoxyethylene alkyl allyl ethers, polyoxyethylene oleyl ether, polyoxyethylene lauryl ether, polyoxyethylene alkyl ethers, polyoxyalkylene alkyl ethers; esters, such as polyoxyethylene oleate, polyoxyethylene distearate, sorbitan laurate, sorbitan monostearate, sorbitan monooleate, sorbitan sesquioleate, polyoxyethylene monooleate, and polyoxyethylene stearate; and glycol surfactants.

Specific examples of non-ionic hydrocarbon surfactants include octylphenoxy polyethoxy ethanols, such as Triton™ X-100, X-114 and X-405, available from Union Carbide Co., Danbury, Conn.; acetylenic diols such as 2,4,7,9-tetramethyl-5-decyn-4,7-diol and the like, such as Surfynol™ GA and Surfynol™ CT-136, available from Air Products & Chemicals Co., Allentown, Pa. trimethyl nonylpolyethylene-glycol ethers, such as Tergitol™ TMN-10 (containing 10 oxyethylene units, believed to be of the formula $C_{12}H_{25}O(C_2H_4O)_5H$), available from Union Carbide Co., Danbury, Conn., non-ionic esters of ethylene oxide, such as Merpol™ SH (believed to be of the formula $CH_3(CH_2)_{12}(OC_2H_4)_8OH$), available from E. I. Du Pont de Nemours & Co., Wilmington, Del., non-ionic esters of ethylene oxide and propylene oxide, such as Merpol™ LFH (believed to be of the formula $CH_3(CH_2)n(OC_2H_4)_8(OC_3H_6)_8OH$, where n is an integer from about 12 to about 16), available from E. I. Du Pont de Nemours & Co., Wilmington, Del., and the like, as well as mixtures thereof.

Non-limiting examples of non-ionic fluorinated surfactants include linear perfluorinated polyethoxylated alcohols (e.g., Zonl™ FSN, Zonl™ FSN-100, Zonyl™ FSO and Zonyl™ FSO-100 available from DuPont Specialty Chemicals, Wilmington, Del.), fluorinated alkyl polyoxyethylene ethanols (e.g., Fluorad™ FC-170C available from 3M, St. Paul, Minn.), fluorinated alkyl alkoxylate (e.g., Fluorad™ FC-171 available from 3M, St. Paul, Minn.), fluorinated alkyl esters (e.g., Fluorad™ FC-430, FC-431 and FC-740 available from 3M, St. Paul, Minn.) and fluorine-substituted alkyl esters and perfluoroalkyl carboxylates (for example, F-tergent series manufactured by Neos Co., Ltd., Lodyne series manufactured by Ciba-Geigy, Monflor series manufactured by ICI, Surfluon series manufactured by Asahi Glass Co., Ltd. and Unidyne series manufactured by Daikin Industries, Ltd.). Preferred nonionic fluoro-carbon surfactants include Zonyl™ FSO, Fluorad™ FC-170C and Fluorad™ FC-171.

The above-described non-ionic surfactants ordinarily make up from 1 to 20 weight % and preferably from 2 to 10 weight % based on the solid content of the ink receiving layer compositions. Accordingly, the resulting ink receiving layers totally comprise a non-ionic surfactant amount of from 1 to 5 g/m$^2$, preferably from 1 to 3 g/m$^2$. When preparing the ink jet receiving sheet by coating a plurality of ink receiving layers, the above mentioned amount of non-ionic surfactants is added to the ink receiving layer nearest to the support.

The support used in the ink jet receiving sheet of the invention includes any conventional support for ink jet receiving sheet. A transparent or opaque support can be optionally used according to its final use. Useful examples of transparent supports include films of polyester resins, cellulose acetate resins, acrylic resins, polycarbonate resins, polyvinyl chloride resins, poly(vinylacetal) resins, polyether resins, polysulfonamide resins, polyamide resins, polyimide resins, cellophane or celluloid and a glass plate. The thickness of the transparent support is preferably 10 to 200 $\mu$m. Useful examples of opaque supports include paper, coated paper, synthetic paper, resin-covered paper, pigment-containing opaque films or foaming films, but synthetic papers, resin-covered papers or various films are preferable in view of glossiness or smoothness and resin-covered papers or polyester films are preferable in view of touchiness or luxuriousness.

The base paper constituting the resin-covered paper useful in the invention is not specifically limited, and any conventional paper can be used, but a smooth paper used as a conventional photographic support is preferable. The pulp used for the preparation of the base paper, singly or in admixture, is constituted by natural pulp, reproduction pulp, chemical pulps such as hardwood bleached kraft pulp, softwood bleached kraft pulp, high yield pulps such as groundwood pulp or thermo-mechanical pulp, recycled pulps and non-wood pulps such as cotton pulp or synthetic pulp. These base papers may contain additives usually employed in paper manufacture such as sizing agents, binders, fixing agents, yield-improving agents, cationated agents, paper stiffness enhancing agents, reinforcing agents, fillers, anti-static agents, fluorescent brightening agents or dyes. A surface sizing agent, a surface reinforcing agent, a fluorescent brightening agent, an antistatic agent and an anchoring agent may be coated on the surface of the material.

The thickness of the base paper is not specifically limited, but is preferably 10 to 200 $\mu$m. A base paper having a smooth surface is preferable, which is obtained by applying pressure to or calendering the paper, during or after papering. The weight of the base paper is preferably 30 to 250 g/m$^2$. The resin used in manufacturing the resin-covered paper is preferably a polyolefin resin or a resin capable of being hardened with an electron beam. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the resin-covered paper preferably contains various additives, for example, white pigment such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an antioxidant such as Irganox™ 1010 or Irganox™ 1076, blue pigment or dyes such as cobalt blue, ultramarine, or phthalocyanide blue, magenta pigment or dyes such as cobalt violet, fast violet or manganese violet, a brightening agent and a UV absorber. These additives can be suitably used in combination.

The resin-covered paper, which is the support preferably used in the present invention, is manufactured by a so-called extrusion method casting a thermally fused resin (for example, fused polyolefin) on the moving paper, whereby both surfaces of the paper are covered with the resin. When the paper is covered with a resin capable of being hardened with electron beam irradiation, the resin is coated with a conventional coater such as a gravure coater or a blade coater and then is irradiated with electron beam to harden the coated resin. Before the paper is coated with a resin, the surface of the paper is preferably subjected to activation treatment such as corona discharge treatment or flame treatment. The surface of the support on the ink receiving layer side is glossy or matted depending upon its usage, and glossy surface is preferable. The back side of a support is not necessarily covered with a resin, but is preerably covered with a resin in view of prevention of curling. The back surface of a support is ordinarily non-glossy, but the back surface or both surfaces of the support are optionally subjected to activation treatment such as corona discharge treatment or flame treatment. The thickness of a covered resin is not specifically limited, but is ordinarily 5 to 50 $\mu$m.

A subbing (also called "primer") layer to improve the adhesion between the film support and the ink receiving layer may be provided. Useful subbing layers for this purpose are widely known in the photographic art and include, for example, polymers of vinylidene chloride such as vinylidene chloride/acrylonitrile/acrylic acid terpolymers or vinylidene chloride/methyl acrylate/itaconic acid terpolymers.

The ink receiving layer(s) of the ink jet receiving sheet of the present invention are obtained by coating on the support different coating compositions comprising the above mentioned solvents and surfactants, as well as other adjuvants, dispersed in a binder. Useful adjuvants are represented by fillers, surfactants, mordants, matting agents, hardeners, plasticizers, and the like.

The binder includes any useful hydrophilic polimer, either natural or synthetic. Useful hydrophilic polymers include polyvinyl alcohol, polyvinyl acetate, acidified starch, ethered starch, polyalkylene glycols (such as polyethylene glycol and polypropylene glycol), cellulose derivatives (such as hydroxyethyl cellulose, hydroxypropyl cellulose, hydroxyethylmethyl cellulose, hydroxypropyl methyl cellulose, hydroxybutylmethyl cellulose, methyl cellulose, sodium carboxymethyl cellulose, sodium carboxymethylhydroexyl cellulose, water soluble ethylhydroxyethyl cellulose, cellulose sulfate), polyvinylpyrolidone, gelatin, dextran, dextrin, arabic gum, casein, pectin, albumin, collagen derivatives, collodion, agar-agar, maleic acid resins, coniugate diene copolymer latexes such as styrene-butadiene resin and methylmethacrylate-butadiene copolymer and acryl copolymer latexes such as a polymer or copolymer of acrylic acid ester and methacrylic acid ester; vinyl copolymer latexes such as ethylene vinyl acetic acid copolymer; and synthetic resin binders such as polymethylmethacrylate, polyurethane resin, unsaturated polyester resin, vinyl chloride-vinyl acetic acid copolymer, polyvinyl acetal type resins and alkyl resins are cited. These resins may be used independently or in combination.

Preferred binders are gelatin, polyvinylpyrrolidone and polyvinylalcohol or binary or ternary blends of these. Gelatin is a particularly preferred material for use in forming the ink receiving layer according to this invention. Among the reasons is the fact that it forms clear coatings, is readily cross-linked in an easily controllable manner, and is highly absorptive of water-based liquid inks thereby providing rapid-drying characteristics.

As gelatin, any gelatin made from animal collagen can be used, but gelatin made from pig skin, cow skin or cow bone collagen is preferable. The kind of gelatin is not specifically limited, but lime-processed gelatin, acid processed gelatin, amino group inactivating gelatin (such as acetylated gelatin, phthaloylated gelatin, malenoylated gelatin, benzoylated gelatin, succinoylated gelatin, methyl urea gelatin, phenylcarbamoylated gelatin, and carboxy modified gelatin), or gelatin derivatives (for example, gelatin derivatives disclosed in JP Patent Publications 38-4854/1962, 39-30 5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and GB Patents 861,414 and 103,189) can be used singly or in combination.

The binder resins ordinarily make up from 30 to 90 weight % and preferably 50 to 80 weight % based on the solid content of the ink receiving layer compositions. Preferably, the ink receiving layers totally comprise a binder amount of from 1 to 20 g/m$^2$, and more preferably from 2 to 10 g/m$^2$.

Inorganic and/or organic particles can be used as filers. Useful examples of fillers are represented by silica (colloidal silica), alumina or alumina hydrate (aluminazol, colloidal alumina, a cation aluminum oxide or its hydrate and pseudoboehmite), a surface-processed cation colloidal silica, aluminum silicate, magnesium silicate, magnesium carbonate, titanium dioxide, zinc oxide, calcium carbonate, kaolin, talc, clay, zinc carbonate, satin white, diatomaceous earth, synthetic amorphous silica, aluminum hydroxide, lithopone, zeolite, magnesium hydroxide and synthetic mica. Of these inorganic pigments, porous inorganic pigments are preferable such as porous synthetic silica, porous calcium carbonate and porous alumina.

Useful examples of organic fillers are represented by polystyrene, polymethacrylate, polymethylmethacrylate, elastomers, ethylene-vinyl acetate copolymers, polyesters, polyester-copolymers, polyacrylates polyvinylethers, polyamides, polyolefines, polysilicones, guanamine resins, polytetrafluoroethylene, elastomeric styrenebutadiene rubber (SBR), urea resins, urea-formalin resins. Such organic fillers may by used in combination, and/or in place of the above-mentioned inorganic fillers.

The above mentioned fillers are added to the ink receiving layer(s) in an amount of from 0.1 to 5 g/m$^2$, preferably from 0.2 to 3 g/m$^2$, most preferably from 0.3 to 1 g/m$^2$.

In addition to the non-ionic surfactants of the present invention, additional surfactants, such as anionic surfactants, amphoteric surfactants and cationic surfactants can be used. Examples of anionic surfactants include alkylsulfocarboxylates, $\alpha$-olefin sulfonates, polyoxyethylene alkyl ether acetates, N-acyl amino acids and the salts thereof, N-acyl methyltaurine salts, alkylsulfates, polyoxy alkyl ether sulfates, polyoxyalkylether phosphates, rosin soap, castor oil sulfate, lauryl alcohol sulfate, alkylphenol phosphates, alkyl phosphates, alkyl allyl sulfonates, diethylsulfosuccinates, diethylhexylsulfosuccinates and dioctylsulfosuccinates. Examples of amphoteric surfactants include lauryl dimethyl aminoacefic acid betaine, 2-alkyl-N-carboxymethyl-N-hydroxyethyl imidazolinium betaine, propyldimethylaminoacetic acid betaine, polyoctyl polyaminoethyl glycine, and imidazoline derivatives. Examples of the cationic surfactant include 2-vinylpyridine derivatives and poly-4-vinylpyridine derivatives.

Mordants may be incorporated in the ink-receptive layer of the present invention. Such mordants are represented by cationic compounds, monomeric or polymeric, capable of complexing with the dyes used in the ink compositions. Useful examples of such mordants include quaternary ammonium block copolymers, such as Mirapol A-15 and MirapoL WT available from Miranol, Incorporated, Dayton, N.J., prepared as disclosed in U.S. Pat. No. 4,157,388, Mirapol AZ-1 available from Miranol, Inc., prepared as disclosed in U.S. Pat. No. 4,719,282, Mirapol AD-1 available from Miranol, Inc., prepared as disclosed in U.S. Pat. No. 4,157,388, Mirapol 9, Mirapol 95 and Mirapol 175 available from Miranol, Inc., prepared as disclosed in U.S. Pat. No. 4,719,282, and the like. Other suitable mordants comprise diaminb alkanes, ammonium quaternary salts (such as poly(vinylbenzyl quaternary ammonium salts disclosed in U.S. Pat. No. 4,794,067), and quaternary acrylic copolymer latexes.

Other suitable mordants are fluoro compounds, such as tetra ammonium fluoride hydrate, 2,2,2-trifluoroethylamine hydrochloride (Aldrich #18,038-6); 2,2,2-trifluoroethyltoluene sulfonate (Aldrich #17,782-2); 1-(α,α,α-trifluoro-m-tolyl) piperazine hydrochloride, 4-bromo-α,α,α-trifluoro-o-toluidine hydrochloride, difluorophenylhydrazine hydrochloride, 4-fluorobenzylamine hydrochloride, 4-fluoro-α,α-dimethylphenethylamine hydrochloride, 2-fluoroethylaminehydrochloride, 2-fluoro-1-methyl pyridinium-toluene sulfonate, 4-fluorophenethylamine hydrochloride, fluorophenylhydrazine hydrochloride, 1-(2-fluorophenyl) piperazine monohydrochloride, 1-fluoro pyridinium trifluoromethane sulfonate.

Further mordants are monoammonium compounds as disclosed, for example, in U.S. Pat. No. 5,320,902, including (A) tetradecyl ammonium bromide (Fluka 87582), tetradodecyl ammonium bromide (Fluka 87249), tetrahexadecyl ammonium bromide (Fluka 87298), tetraoctadecyl ammonium bromide (Aldrich 35,873-8), and the like; (B) 2-coco trimethyl ammonium chloride (Arquad C-33, C-33W, C-50 from Akzo Chemie), palmityl trimethyl ammonium chloride (Adogen 444 from Sherex Chemicals), myristyl trimethyl ammonium bromide (Cetrimide BP Triple Crown America), benzyl tetradecyl dimethyl ammonium chloride (Arquad DM 14B-90 from Akzo Chemie), didecyl dimethyl ammonium bromide (Aldrich 29,801-8), dicetyl dimethyl ammonium chloride (Adogen 432CG, Sherex Chemicals), distearyl dimethyl ammonium methyl sulfate (Varisoft 137, 190-100P from Sherex Chemicals, Arosurf TA-100 from Sherex Chemicals), fatty acid isopropyl ester dimethyl ammonium methyl sulfate (Rewoquat CR 3099 from Rewo Quimica, Loraquat CR 3099 from Dutton and Reinisch), tallow dimethyl trimethyl propylene diammonium chloride (Tomah Q-D-T from Tomah), and N-cetyl,N-ethyl morpholinium ethosulfate (G-263 from ICI Americas).

Additional mordants are phosphonium compounds, such as, for example, those disclosed in U.S. Pat. No. 5,766,809, including bromomethyl triphenyl phosphonium bromide (Aldrich 26,915-8), 3-hydroxy-2-methyl propyl triphenyl phosphonium bromide (Aldrich 32,507-4), 2-tetraphenyl phosphonium bromide (Aldrich 21,878-2), tetraphenyl phosphonium chloride (Aldrich 21879-0), hexadecyl tributyl phosphonium bromide (Aldrich 27,620-0), and stearyl tributyl phosphonium bromide (Aldrich 29,303-2).

Additional examples of mordants include those disclosed in U.S. Pat. Nos. 5,760,809, 5,457,486, 5,314,747, 5,320,902 and 5,441,795.

The ink receiving layer(s) may also contain a glossiness improving agent represented by monosaccharides and/or oligosaccharides and/or polysaccharides having a recurring unit comprising five or six carbon atoms. The saccharide derivatives can be hydrogenated or non hydrogenated. Said saccharides can be hydrogenated or non-hydrogenated. Preferred recurring units include, for example, glucose, xylose, mannose, arabinose, galactose, sorbose, fructose, fucose, adonitol, arbitol, inositol, xylitol, dulcitol, iditol, lactitol, mannitol, sorbitol, and the like. The average molecular weight of said saccharides ranges from 1,000 to 500,000, preferably from 1,000 to 30,000.

Hydrogenated and non-hydrogenated saccharides useful in the present invention are commercially available, for example, under the trade designation POLYSORB™ or GLUCIDEX™, from Roquette, Lille, France. The preparation of hydrogenated and non-hydrogenated saccharides usually starts from natural products (like starch, agar, tragacanth gum, xanthan gum, guar gum, and the like ) by means of enzymatic processes (to reduce the average molecular weight) and of reducing processes (to saturate the molecule, in case of hydrogenated saccharides).

The above-described glossiness improving agents ordinarily make up to 30 weight % and preferably up to 20 weight % based on the solid content of the ink receiving layer compositions. Preferably, the resulting ink receiving layers totally comprise a glossiness improving agent amount of from 0.1 to 5 g/m$^2$, preferably from 0.5 to 3 g/m$^2$.

The ink receiving layer can be hardened with a hardener in order to improve water resistance or dot reproduction. Examples of the hardener includes aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed U.S. Pat. No. 3,288,775, carbamoyl pirydinium compounds wherein the pirydinium ring contains a sulfate or alkylsulafte group disclosed in U.S. Pat. Nos. 4,063,952 and 5.529,892, divinylsulfones, reactive olefin-containing compounds disclosed U.S. Pat. No. 3,635,718, N-methylol compounds disclosed in U.S. Pat. No. 2,732,316, isocyanates disclosed U.S. Pat. No. 3,103,437, aziridine compounds disclosed U.S. Pat. Nos. 3,017,280 and 2,983,611, carbodiimides disclosed in U.S. Pat. No. 3,100,704, epoxy compounds disclosed in U.S. Pat. No. 3,091,537, halogencarboxyaldehydes such as mucochloric acid, dioxane derivatives such as dihydroxy dioxane, and inorganic hardeners such as chromium alum, potash alum and zirconium sulfate. These hardeners can be used alone or in combination. The addition amount of hardener is preferably from 0.01 to 10 g, and more preferably from 0.1 to 5 g based on 100 g of a binder contained in the ink receiving layer.

The ink receiving layer may contain a matting agent in an amount from 0.005 to 0.3 g/m$^2$ in order to prevent adhesion defect such as blocking. The matting agents can be defined as particles of inorganic or organic materials capable of being discontinuously dispersed in a hydrophilic organic colloid. The inorganic matting agents include oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of an iodine atom), and glass. Besides these substances, inorganic matting agents disclosed in DE Patent No. 2,529,321, GB patents 760 775 and 1,260,772, and U.S. Pat. Nos. 1,201,905, 2,192,241, 3,053,662, 3,062,649, 3,257,296, 3,322.555, 3,353,958, 3,370,951, 15 3,411,907, 3,437,484, 3,523,022, 3,615,554, 3,635,714, 3,769,020, 4,021,245 and 4,029,504 can be used. The organic matting agents include starch, cellulose esters such as cellulose acetate propionate, cellulose ethers such as ethyl cellulose and synthetic resins. The synthetic resins are a water insoluble or sparingly soluble polymer which includes a polymer of alkyl(meth)acrylate, an alkoxyalkyl-(meth)acrylate, a glycidyl(meth)acrylate, a (meth)acrylamide, a vinyl ester such as vinyl acetate, acrylonitrile, an olefin such as ethylene or styrene and a copolymer of the above described monomer with other monomers such as acrylic acid, methacrylic acid, α,β-unsaturated dicarboxylic acid, hydroxyalkyl(meth)acrylate, sulfoalkyl(meth)acrylate and styrene sulfonic acid. Further, a benzoguanamin-formaldehyde resin, an epoxy resin, nylon, polycarbonates, phenol resins, polyvinyl carbazol or polyvinylidene chloride can be used. Besides the above compounds, organic matting agents which are disclosed in GB Patent 1,055,713, in U.S. Pat. Nos. 1,939,213; 2,221,873; 2,268,662; 2,322,037; 2,376,005; 2,391,181; 2,701,245; 2,992,101; 3,079,257; 3,262,782; 3,443,946; 3,516,832; 3,539,344,554; 3,591,379; 3,754,924 and 3,767,448; in JP patents 49-106821/1974 and 57-14835/1982 can be used. These matting agents may be used either alone or in combination.

The ink-receiving layer of the present invention can also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromphthalic anhydride, urea phosphate, triphenylphosphate, glycerol monostearate, propylene glycol monostearate, tetramethylene sulfone, N-methyl-2-pyrrolidone, N-vinyl-2-pyrrolidone, and polymer latices with low Tg-value such as polyethylacrylate, polymethylacrylate, etc.

The ink receiving layer can comprise biocides. Examples of suitable biocides include (A) nonionic biocides, such as 2-bromo-4'-hydroxyacetophenone (Busan 90 available from Buckman Laboratories); 3,5-dimethyl tetrahydro2H-1,3,5-thiadiazine-2-thione (Slime-Trol RX-28 available from Betz Paper Chem Inc.); a nonionic blend of 5-chloro-2-methyl-4-isothiazoline-3-one, 75 percent by weight, and 2-methyl-4-isothiazolin-3-one, 25 percent by weight (available as Amerstat 250 from Drew Industrial Division; Nalcon 7647 from Nalco Chemical Company; Kathon LX from Rohm and Haas Company); and the like, as well as mixtures thereof; (B) anionic biocides, such as anionic potassium N-hydroxymethyl-N-methyl-dithiocarbamate (available as Busan 40 from Buckman Laboratories Inc.); an anionic blend of methylene bis-thiocyanate, 33% by weight, sodium dimethyl-dithiocarbamate, 33% by weight, and sodium ethylene bisdithiocarbamate, 33% by weight, (available as Amerstat 282 from Drew Industrial Division; AMA-131 from Vinings Chemical Company); sodium dichlorophene (G-4-40 available from Givaudan Corporation); and the like, as well as mixtures thereof; (C) cathionic biocides, such as cathionic poly(oxyethylene (dimethylamino)ethylene (dimethylamino) ethylene dichloride) (Busan 77 available from Buckman Laboratories Inc.); a cathionic blend of bis(trichloromethyl) sulfone and a quaternary ammonium chloride (available as Slime-Trol RX-36 DPB865 from Betz Paper Chem. Inc.); and the like, as well as mixtures thereof. The biocide can be present in any effective amount; typically, the biocide is present in an amount of from about 0.1% to 3% by weight of the coating composition, although the amount can be outside this range.

The ink receiving layer in the invention may further contain various conventional additives such as colorants, colored pigments, pigment dispersants, lubricants, permeating agents, fixing agents for ink dyes, UV absorbers, antioxidants, dispersing agents, anti-foaming agents, leveling agents, fluidity improving agents, antiseptic agents, brightening agents, viscosity stabilizing and/or enhancing agents, pH adjusting agents, anti-mildew agents, anti-fungal agents, agents for moisture-proofing, agents for increasing the stiffness of wet paper, agents for increasing the stiffness of dry paper and anti-static agents.

The above-mentioned various additives can be added ordinarily in a range of 0 to 10% by weight based on the solid content of the ink receiving layer composition.

As a coating method of an ink receiving layer coating solution, any conventional coating method (for example, a curtain method, an extrusion method, an air-knife method, a slide coating, a roll coating method, reverse roll coating, solvent extrusion, dip coating processes and a rod bar coating method) can be used.

The ink-receiving layers of the present invention may be preferably coated on one side of the support as a plurality of two or more distinct layers, coated from different coating solutions. Most preferably, the ink-receiving layer of the present invention is coated on one side of the support as a plurality of three distinct layers, coated from different coating solutions. When preparing an ink-jet receiving element according to this invention by coating two or more ink-receing layers onto a support, it is possible to prepare an ink-receiving element with excellent properties, especially with respect to ink absorbency and waterfastness.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLES

Example 1

Sample 1 (reference). A receiving ink jet sheet was prepared using a support comprising a paper base having a weight of 170 g/m$^2$. A resin part having a weight of 25 g/m$^2$ of low density polyethylene was coated on both sides. A gelatin primer was coated on the front side and an anticurl gelatin layer was coated on the back side.

Three different coating solutions were coated all at once with an extrusion system at 10.6 meter per minute on the front side of the aforementioned support.

The composition of the three coating solutions is reported in the following tables 1 to 3.

TABLE 1

Coating solution for first layer

| Compounds | Weight % |
|---|---|
| Gelatin | 4.00 |
| PVP-K 90 | 2.00 |
| Glucidex-6 | 0.65 |
| Triton X 100 | 0.06 |
| Water | 93.29 |

TABLE 2

Coating solution for second layer

| Compounds | Weight % |
|---|---|
| Gelatin | 4.00 |
| PVP-K 90 | 2.00 |
| Glucidex-6 | 2.22 |
| Triton X 100 | 0.18 |
| $Al_2O_3$ | 0.90 |
| Water | 90.70 |

TABLE 3

| Coating solution for third layer | |
|---|---|
| Compounds | Weight % |
| Gelatin | 2.75 |
| PVP-K 90 | 1.37 |
| Glucidex-6 | 0.67 |
| Zonyl FSN-100 | 0.42 |
| Cross-linking agent | 2.60 |
| Water | 92.19 |

The resulting coating was dried to give a multilayer inkjet receiving sheet having the following composition:

First layer: 3.6 g/m$^2$ of gelatin, 1.81 g/m$^2$ of PVP-K 90, 0.06 g/m$^2$ of Triton™ X-100, and 0.58 g/m$^2$ of Glucidex-6™;

Second layer: 3.40 g/m$^2$ of gelatin, 1.70 g/m$^2$ of PVP-K 90, 1.88 g/m$^2$ of Glucidex-6™, 0.15 g/m$^2$ of Triton™ X-100, and 0.76 g/m$^2$ of fines particles of aluminum oxide;

Third layer: 0.47 g/m$^2$ of gelatin, 0.23 g/m$^2$ of PVP-K 90, 0.11 g/m$^2$ of Glucidex-6™, 0.07 g/m$^2$ of Zonyl™ FSN100, and 0.04 g/m$^2$ of cross-linking agent H-1.

Triton™ X-100 is the trade name of a non-ionic surfactant of the alkylphenoxyethylene type having the following formula:

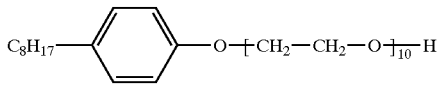

Glucidex-6™ is the trade name of a polysaccharide available from Roquette Freres S. A., Lille, France.

Zonyl™ SFN is the trade name of a non-ionic surfactant of the perfluoroalkyl-polyoxyethylene type, manufactured by DuPont and having the following formula:

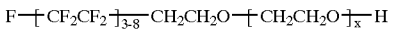

PVP-K 90 is a polyvinylpyrrolidone available from Fluka.

Cross-linking agent H-1 is a piridynium derivative having the following formula:

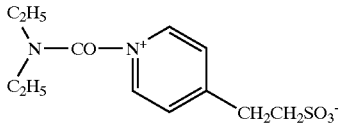

Sample 2 (reference). The procedure of sample 1 was repeated with the same ingredients, except that the first layer coating solution comprises an increased amount of Triton™ X-100 to obtain a coverage of 2.88 g/m$^2$ in the resulting first layer.

Sample 3 to 7 (invention). The procedure of sample 1 was repeated with the same ingredients, except that the first layer coating solution comprised a water insoluble oil compound dispersed as fines oil drops and an increased amount of Triton™ X-100 to obtain a coverage of 2.88 g/m$^2$ in the resulting first layer. The oil dispersion was prepared with 6% gelatin, 8% oil, 5% Triton™ X-100 as surfactant and 81% deionized water. The oil coverage for each sample 3 to 7 is reported in the following Table 4.

A black patch image was recorded on the samples 1 to 7 using two different ink jet printers, an HP Deskjet 870 Cxi (produced by Hewlett Packard) and a Stylus color (produced by Epson).

The black density was generated using carbon black in case of HP printer, and using primary dye combination in case of Epson printer, but in both cases ink was uniformly jetted at maximum ink jetting amount possibility of each printer.

The black density was measured with a Macbeth TR 1224 densitometer, the glossiness was measured on unprinted sheet at an angle of 60° with a TRI-Microgloss-160 (Produced by Sheen), as disclosed in ASTM standard No. 523. The results are reported in the following table 4.

TABLE 4

| | | | Triton ™ | | Black Density | |
|---|---|---|---|---|---|---|
| Sample | Oil Compounds | g/m$^2$ | X-100 g/m$^2$ | Glossy 60° | HP 870 Cxi | Epson 740 |
| 1 (Ref.) | — | — | 0.06 | 87.6 | 2.37 | 1.82 |
| 2 (Ref.) | — | — | 2.88 | 83.9 | 1.98 | 2.19 |
| 3 (Inv.) | DOC | 4.53 | 2.88 | 87.1 | 2.41 | 2.20 |
| 4 (Inv.) | TCP | 4.53 | 2.88 | 84.4 | 2.40 | 2.27 |
| 5 (Inv.) | B2EHF | 4.53 | 2.88 | 84.4 | 2.41 | 2.20 |
| 6 (Inv.) | DBP | 4.53 | 2.88 | 86.5 | 2.39 | 2.31 |
| 7 (Inv.) | DEL | 4.53 | 2.88 | 87.8 | 2.42 | 2.30 |

The comparison of reference samples 1 and 2 clearly shows that the increase of surfactants in the first layer of the inkjet receiving sheet improved the black density using Epson printer, but drastically decreased the black density measured using HP printer.

Samples 3 to 7 clearly show that by using the combination of the present invention it is possible to obtain a good black density both with Epson and HP printers, without deterioring the glossy aspect.

The formula of compounds employed in the above samples can be found in the following Table 5.

TABLE 5

| | |
|---|---|
| DOC : Dioctyl carbonate | $[CH_3—(CH_2)_7—O—]_2C=O$ |
| TCP : Tricresyl phosphate | $(CH_3—C_6H_4—O)_3P=O$ |
| B2EHF : Bis(2-ethylhexyl) phtalate | $[CH_3—(CH_2)_3—CH(C_2H_5)—CH_2—O—CO—]_2C_6H_4$ |
| DBP : Dibutyl phtalate | $[CH_3—(CH_2)_3—O—CO—]_2C_6H_4$ |
| DEL : Diethyl lauramide | $CH_3—(CH_2)_{10}—CO—N(—CH_2—CH_3)_2$ |

What is claimed is:

1. An ink jet receiving sheet comprising a support and at least one ink receiving layer, characterized in that said ink receiving layer comprises a high boiling organic solvent and a non-ionic surfactant dispersed in a hydrophilic binder, characterized in that said receiving sheet comprises at least two ink receiving layers coated one on top of the other on the same side of the support, and in that said high-boiling organic solvent and said non-ionic surfactant are added to the ink receiving layer nearest to the support in an amount ranging from 1 to 10 g/m$^2$ and from 1 to 5 g/m$^2$, respectively.

2. The ink jet receiving sheet according to claim 1, characterized in that said high boiling organic solvent is present In en amount of from 1 to 10 g/m$^2$.

3. The ink jet receiving sheet according to claim 1, characterized in that said high boiling organic solvent is selected from the group consisting of alkyl carbonates, phosphoric esters, alkyl phthalates, dibutyl phthalate and alkylamides.

4. The ink jet receiving sheet according to claim 1, characterized in that said high boiling organic solvent is selected from the group consisting of dioctyl carbonate, tricresyl phosphate, bis(2-ethylhexyl) phtalate, dibutyl phtalate, diethyl lauramide.

5. The ink jet receiving sheet according to claim 1, characterized in that said non-ionic surfactant is present in an amount from 1 to 5 g/m$^2$.

6. The ink jet receiving sheet according to claim 1, caracterized in that said non-ionic surfactant is selected from the class consisting of non-ionic hydrocarbon surfactant and non-ionic fluorinated surfactant.

7. The ink jet receiving sheet according to claim 6, characterized in that said non-ionic hydrocarbon surfactant is selected from the group consisting of ethers, esters, glycols, octylphenoxy polyethoxy ethanols, acetylenic diols, trimethyl nonylpolyethylene-glycol ethers, non-ionic esters of ethylene oxide, and non-ionic esters of ethylene oxide and propylene oxide.

8. The ink jet receiving sheet according to claim 6, characterized in that said non-ionic fluorinated surfactant is selected from the group consisting of perfluorinated polyethoxylated alcohols, fluorinated alkyl polyoxyethylene ethanols, fluorinated alkyl alkoxylates, fluorinated alkyl esters, and fluorine-substituted alkyl esters and perfluoroalkyl carboxylates.

9. The ink jet receiving sheet according to claim 1, characterized in that said hydrophilic binder is gelatin.

10. An ink jet receiving sheet comprising a support and at least one ink receiving layer, characterized in that said ink receiving layer consists essentially of a high boiling organic solvent and a non-ionic surfactant dispersed in a hydrophilic binder, characterized in that said receiving sheet comprises at least two ink receiving layers coated one on top of the other on the same side of the support, and in that said high-boiling organic solvent and said non-ionic surfactant are added to the ink receiving layer nearest to the support in an amount ranging from 1 to 10 g/m$^2$ and from 1 to 5 g/m$^2$, respectively.

11. The ink jet receiving sheet according to claim 10, characterized in that said high boiling organic solvent is present in an amount of from 1 to 10 g/m$^2$.

12. The ink jet receiving sheet according to claim 10, characterized in that said high boiling organic solvent is selected from the group consisting of alkyl carbonates, phosphoric esters, alkyl phthalates, dibutyl phthalate and alkylamides.

13. The ink jet receiving sheet according to claim 10, characterized in that said high boiling organic solvent is selected from the group consisting of dioctyl carbonate, tricresyl phosphate, bis(2ethylhexyl) phthalate, dibutyl phthalate, diethyl lauramide.

14. The ink jet receiving sheet according to claim 10, characterized in that said non-ionic surfactant is present in an amount from 1 to 5 g/m$^2$.

15. The ink jet receiving sheet according to claim 10, characterized in that said non-ionic surfactant is selected from the class consisting of non-ionic hydrocarbon surfactant and non-ionic fluorinated surfactant.

16. The ink jet receiving sheet according to claim 10, characterized in that said non-ionic hydrocarbon surfactant is selected from the group consisting of ethers, esters, glycols, octylphenoxy polyethoxy ethanols, acetylenic diols, trimethyl nonylpolyethylene-glycol ethers, non-ionic esters of ethylene oxide, and non-ionic esters of ethylene oxide and propylene oxide.

17. The ink jet receiving sheet according to claim 15, characterized in that said non-ionic fluorinated surfactant is selected from the group consisting of perfluorinated polyethoxylated alcohols, fluorinated alkyl polyoxyethylene ethanols, fluorinated alkyl alkoxylates, fluorinated alkyl esters, and fluorine-substituted alkyl esters and perfluoroalkyl carboxylates.

18. The ink jet receiving sheet according to claim 10, characterized in that said hydrophilic binder is gelatin.

* * * * *